US006539553B2

(12) United States Patent
Day

(10) Patent No.: US 6,539,553 B2
(45) Date of Patent: Apr. 1, 2003

(54) HAT WITH ADJUSTABLE BAND AND INTERCHANGEABLE ORNAMENTS

(76) Inventor: Mindy Day, 2401 Stonefield Way, Medford, OR (US) 97501

( * ) Notice: Subject to any disclaimer, the term of this patent is extended or adjusted under 35 U.S.C. 154(b) by 0 days.

(21) Appl. No.: 09/849,283

(22) Filed: May 4, 2001

(65) Prior Publication Data

US 2002/0162158 A1 Nov. 7, 2002

(51) Int. Cl.[7] ..... A42B 1/00
(52) U.S. Cl. ..... 2/175.1; 2/209.13
(58) Field of Search ..... 2/175.1, 181, 182.6, 2/209.5, 209.7, DIG. 1, 183, 209.13, 195.7

(56) References Cited

U.S. PATENT DOCUMENTS 3,428,963 A * 2/1969 Centeck ..... 2/209.13
5,495,622 A * 3/1996 Kaufman ..... 2/175.1
5,664,261 A * 9/1997 Lacy ..... 2/172
5,803,266 A * 9/1998 Blackwelder ..... 206/575

* cited by examiner

*Primary Examiner*—John J. Calvert
*Assistant Examiner*—Katherine Moran
(74) *Attorney, Agent, or Firm*—Michael I Kroll

(57) ABSTRACT

The present invention 10 discloses a hat with an adjustable elastic band 20 for infants and small children having interchangeable decorative ornaments 14 and an elastic band 20 that may be adjusted accordingly to maintain the hat on a child's head 12 without increasing the stress applied thereto as the child grows. The elastic band 20 provides for air spaces 34 between the hat 10 and the baby's head 12 to provide ventilation 36 therethrough. A means 16 for removably securing decorative ornaments 14 such as flowers, butterflies, cartoon characters and the like is provided on an exterior portion of the hat. The present invention 10 provides a means for maintaining a hat that will not need to be replaced as often as hats shown in the prior art because the present invention could be adjusted accordingly as the child 12 grows and could also be accessorized to go with different outfits.

1 Claim, 11 Drawing Sheets

HAT WITH ADJUSTABLE BAND AND INTERCHANGEABLE ORNAMENTS

BACKGROUND OF THE INVENTION

1. Field of the Invention

The present invention relates generally to hats with elastic bands, and more specifically, to a hat for infants and small children having interchangeable decorative ornaments and an elastic band that may be adjusted accordingly to maintain the hat on a child's head without increasing the stress applied thereto as the child grows. The elastic band provides for separation between the hat and the baby's head to provide ventilation therethrough. A means for removably securing decorative ornaments such as flowers, butterflies, cartoon characters and the like is provided on an exterior portion of the hat. The present invention provides a safe and comfortable means for maintaining a hat on a child's head during activity that will not need to be replaced as often as hats shown in the prior art because the present invention could be adjusted accordingly as the child grows and could also be accessorized to go with different outfits.

2. Description of the Prior Art

There are other hats with adjustable bands designed to improve the fit of a hat. Typical of these is U.S. Pat. No. 92,785 issued to T. W. Bracher on Jul. 20, 1869.

Another patent was issued to J. Jaillet et al. on May 26, 1908 as U.S. Pat. No. 888,902. Yet another U.S. Pat. No. 1,275,238 was issued to Leon Freeman on Aug. 13, 1918 and still yet another was issued on Oct. 28, 1924 to Harry B. Saxton as U.S. Pat. No. 1,513,632. Another patent was issued to Gilbert T. Wagenfeld on Jun. 20, 1961 as U.S. Pat. No. 2,988,743. One other patent was issued to Kuninori Kimotsuki on Jan. 2, 1979 as U.S. Pat. No. 4,131,953. Still another patent was issued to Gary L. Moore on Sep. 10, 1996 as U.S. Pat. No. 5,553,326. Yet another patent was issued to Michael K. Proctor on Jun. 30, 1998 as U.S. Pat. No. 5,771,493. On Aug. 6, 1999 U.S. Pat. No. 5,890,230 was issued to Tian-Song Guo and a patent was issued to Young-Min Lee et al. on Dec. 14, 1999 as U.S. Pat. No. 6,000,105. On Aug. 1, 2000 Michael K. Proctor was issued U.S. Pat. No. 6,094,749 and a patent was issued to Joseph Whang on Mar. 13, 2001 as U.S. Pat. No. 6,199,213.

U.S. Pat. No. 92,785

Inventor: Thomas W. Bracher

Issued: Jul. 20, 1869

This invention relates to a hat ventilator, composed of two corrugated segments of sheet metal or other suitable material which are secured between the hatbody and the sweat lining in front and rear of the hat in combination with a dust valve composed of one or more pieces of leather or other suitable flexible material, which are fastened to the interior of the hat body.

U.S. Pat. No. 888,902

Inventor: Jules Jaillet et al.

Issued: May 26, 1908

The combination with head gear of a band for supporting said head gear on the head of the wearer, said band being spaced from said head gear, a curtain contacting at one edge with the head gear, and a spiral wire at the other edge of the curtain adapted to be contracted or extended to adjust the said edge in contact with or at a desired distance from said band.

U.S. Pat. No. 1,275,238

Inventor: Leon Freeman

Issued: Aug. 13, 1918

A hat lining comprising in combination a part having a hand opening therein, catch elements spaced apart about said opening, a closure for said opening, catch elements spaced apart about said closure and adapted to cooperate with said first mentioned catch elements for holding the closure in closing position on said part having the opening, said catch elements being readily operable to release said closure to admit the hand to be passed through said opening.

U.S. Pat. No. 1,513,632

Inventor: Harry B. Saxton

Issued: Oct. 28, 1924

A cap and the like having a crown provided at it's bottom edge with a visor-like projection, a sweat band secured within the crown, spaced at the front from said projection, a ventilating strip of coarse resilient material covering said space, and having its edges secured to the adjacent portions of the visor-like projection and the sweat band, the strip being so arranged that it's strands extend diagonally with said edges.

U.S. Pat. No. 2,988,743

Inventor: Gilbert B. Wagenfeld

Issued: Jun. 20, 1961

In a sheet material blank of the character described, a principal part having a peak area, and a pair of arms extending from opposite ends thereof in laterally spaced relation, and an auxiliary part spanning said arms and disposed intermediate said peak and the free terminal portions of said arms, said blank being scored between each terminal of said auxiliary part and the adjacent one of said arms for facilitating separation of said auxiliary part from said principal part, and said auxiliary part being provided with a pair of slits extending respectively across the opposite portions thereof, said slits being of a length slightly in excess of the width of said arms.

U.S. Pat. No. 4,131,953

Inventor: Kuninori Kimotsuki

Issued: Jan. 2, 1979

A ventilating cap essentially consisting of an inner frame and a shell having the shape of an inverted cup and dimensioned to envelop the frame. The frame includes a hatband extending in a closed loop about an axis and ribs attached to the band in circumferentially spaced relationship. The ribs extend from the band in a common axial direction and converge toward the axis. Respective portions of the ribs remote from the band and adjacent to the axis are fastened to each other. The rim portion of the shell is releasably fastened to the outer face of the head band in spaced relationship so as to define an annular ventilating gap, and an opening in the shell aligned with the fastened portions of, the ribs may be obstructed at least in part by a larger disc releasably fastened to the ribs.

U.S. Pat. No. 5,553,326

Inventor: Gary L. Moore

Issued: Sep. 10, 1996

A system for adapting a hat of the type which is originally provided with only a permanent sweat band, so that the hat can receive a removable, washable, and reusable sweat band. Hats may also be manufactured with the system in place.

U.S. Pat. No. 5,771,493

Inventor: Michael Proctor

Issued: Jun. 30, 1998

A head wear system including a sizing band and a hat. The sizing band is distinct from the hat. The hat comprises a bill and a cap having an opening at the back as well as a headband. The head wear system also includes a first and second adjustment means for selectively nondestructively attaching each end of the sizing band to the hat in a longitudinal relationship therebetween selected by the wearer. When the sizing band is attached to the hat by the first and second adjusting means, the sizing band extends across the opening of the cap. The head wear system also comprises an ornament, a cover means for accessorizing the hat, and an attachment means for selectively nondestructively connecting the cover means and ornament to the crown of the cap. One embodiment of the sizing band functions as a skin stencil and comprises a substrate transparent to ultraviolet radiation and a design opaque to ultraviolet radiation that is attached to the substrate. When the substrate contacts the skin of a wearer the ultraviolet radiation causes the skin under the substrate to tan. At the same time, the design blocks the ultraviolet radiation and causes the skin directly under the design to be unaffected by the ultraviolet radiation resulting in a shadow having the configuration of the design being formed in the skin of the wearer.

U.S. Pat. No. 5,890,230

Inventor: Tian Song Guo

Issued: Apr. 6, 1999

Disclosed is a hat that can be made of multiple pieces or one integral piece of soft material sewed into a hat body having a crown portion and a brim portion. An elastic band is sewed onto and along a lower inner periphery of the crown portion of the hat body in specially patterned stitches to replace the lining band and decorative hatband usually used on a conventional hat. The hat can be folded without becoming deformed. The elastic band provides the hat with adjustable size and tightness to suit to different head shapes and sizes.

U.S. Pat. No. 6,000,105

Inventor: YoungMin Lee et al.

Issued: Dec. 14, 1999

Disclosed is a hat that can be made of multiple pieces or one integral piece of soft material sewed into a hat body having a crown portion and a brim portion. An elastic band is sewed onto and along a lower inner periphery of the crown portion of the hat body in specially patterned stitches to replace the lining band and decorative hatband usually used on a conventional hat. The hat can be folded without becoming deformed. The elastic band provides the hat with adjustable size and tightness to suit to different head shapes and sizes.

U.S. Pat. No. 6,094,749

Inventor: Michael K. Proctor

Issued: Aug. 1, 2000

A head wear system including a sizing band and a hat. The sizing band is distinct from the hat. The hat comprises a bill and a cap having an opening at the back as well as a headband. The head wear system also includes a first and second adjustment means for selectively nondestructively attaching each end of the sizing band to the hat in a longitudinal relationship therebetween selected by the wearer. When the sizing band is attached to the hat by the first and second adjusting means, the sizing band extends across the opening of the cap. The head wear system also comprises an ornament, a cover means for accessorizing the hat, and an attachment means for selectively nondestructively connecting the cover means and ornament to the crown of the cap. One embodiment of the sizing band functions as a skin stencil and comprises a substrate transparent to ultraviolet radiation and a design opaque to ultraviolet radiation that is attached to the substrate. When the substrate contacts the skin of a wearer the ultraviolet radiation causes the skin under the substrate to tan. At the same time, the design blocks the ultraviolet radiation and causes the skin directly under the design to be unaffected by the ultraviolet radiation resulting in a shadow having the configuration of the design being formed in the skin of the wearer.

U.S. Pat. No. 6,199,213 B1

Inventor: Joseph Whang

Issued: Mar. 13, 2001

A modified cap construction utilizes the natural stretch of fabrics to acquire a multi-axial flexibility capable of comfortably fitting wearers having a range of head sizes. The same theory may be applied to any article of manufacture that is designed to be worn on or around the head. The unique sweatband portion is fashioned with a soft, absorbent and non-oppressive multi-axially stretchable fabric that is attached along its lower edge to the interior surface of the material of the hat. The structure and multiple size capability of the free size fitted cap offers the aesthetic appeal of the fixed size style cap together with the feel of its custom fit and the lasting shape of its fabric.

There are numerous hats with adjustable bands, while these adjustable hat bands may be suitable for the purposes for which they were designed, they would not be as suitable for the purposes of the present invention as hereinafter described.

SUMMARY OF THE PRESENT INVENTION

The present invention discloses a hat having interchangeable decorative ornaments and an elastic band that may be adjusted accordingly to maintain the hat on a child's head without increasing the stress applied thereto as the child grows. The elastic band also provides for air spaces between the hat and the baby's head to provide ventilation therethrough. A means for removably securing decorative ornaments such as flowers, butterflies, cartoon characters and the like is provided on an exterior portion of the hat. The present invention provides a means for maintaining a hat that will not need to be replaced as often as hats shown in the prior art because the present invention could be adjusted accordingly as the child grows and could also be accessorized to go with different outfits.

A primary object of the present invention is to provide a hat for infants and toddlers having an adjustable elastic band that can be selectively fitted to be worn securely on a child's head without causing undue pressure.

An additional object of the present invention is to provide a hat for infants and toddlers with an adjustable elastic band having interchangeable decorative ornaments that would allow a parent to accessorize the hat with different outfits.

A further object of the present invention is to provide a hat for infants and toddlers with an adjustable elastic band having interchangeable decorative ornaments wherein the elastic band is secured to opposing portions of the interior of the hat thereby enabling the elastic band to encompass the circumference of the child's head while pinching the hat member to create gaps between the child's head and the hat member to provide ventilation thus increasing the comfort and safety of the child.

A yet further object of the present invention is to provide a hat for infants and toddlers with an adjustable elastic band having interchangeable decorative ornaments wherein the opposing portions of the interior of the hat to which the elastic band is secured are situated in the front and the rear to help keep the decorative ornament centered towards the front.

Another object of the present invention is to provide a hat for infants and toddlers with an adjustable elastic band having interchangeable decorative ornaments.

One more object of the present invention is to provide a hat for infants and toddlers with an adjustable elastic band having interchangeable decorative ornaments that is simple and easy to use.

A further object of the present invention is to provide a hat for infants and toddlers with an adjustable elastic band having interchangeable decorative ornaments that is economical in cost to manufacture.

Further objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
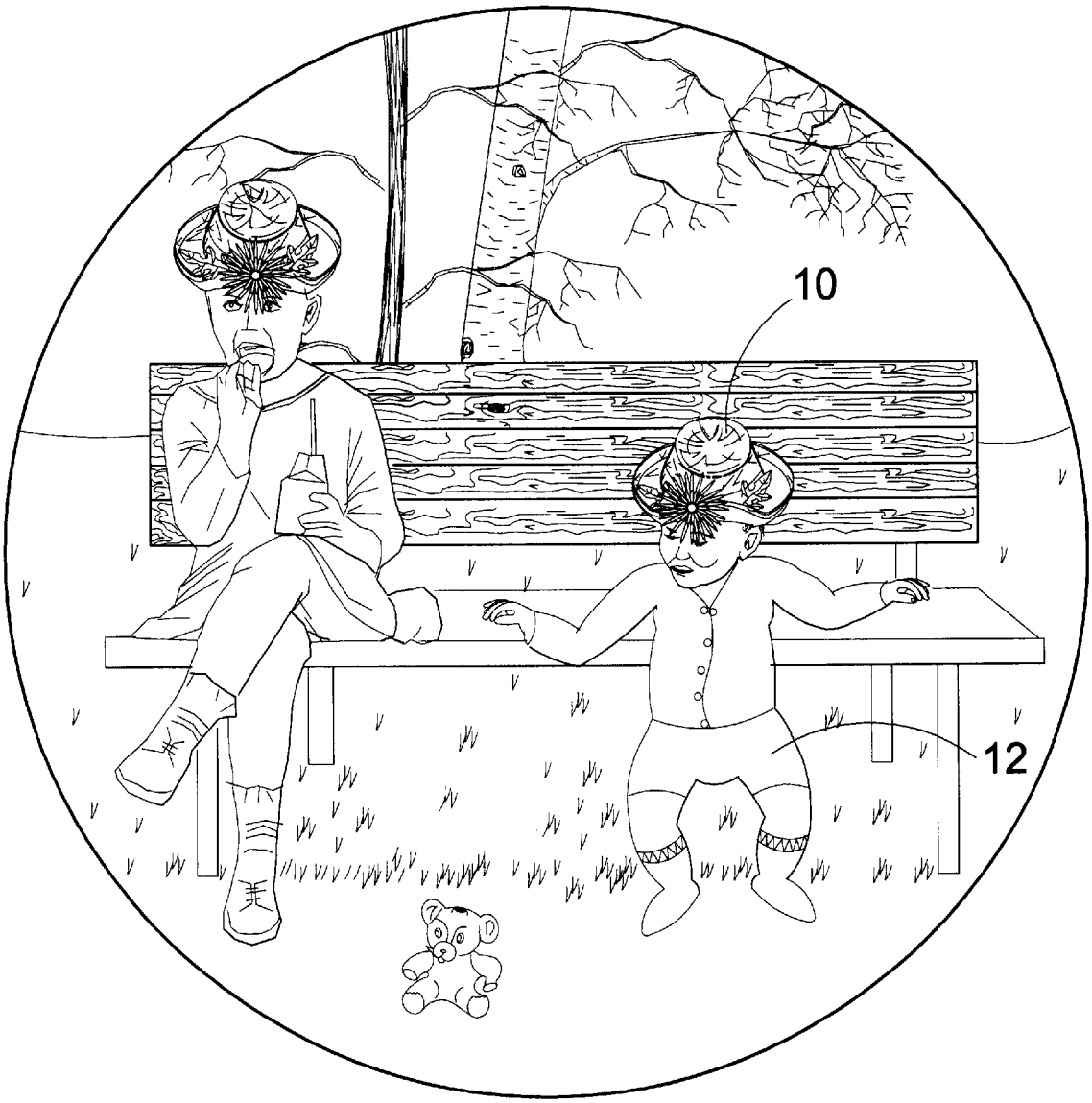
FIG. 1 is a perspective view of the present invention in use.

10 present invention
12 toddler
14 flower ornament
16 fastener means
20 elastic band
22 front of hat
24 rear retaining loop
26 mating ends of hook and loop material
28 adhesive attachment
29 adhesive attachment
30 hat brim fold
32 inside wall
33 outside wall
34 gap
36 air ventilation

DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For definition of the complete scope of the invention, the reader is directed to the appended claims.

Turning to FIG. 1, shown therein is a perspective view of the present invention 10 in use. As will be further explained hereinafter, the present invention 10 is a hat for infants and toddlers 12 that provides an interior adjustable elastic strap having hook and loop fasteners on each end with a first end fixedly attached to a front portion of the hat's interior and a second end that passes through a retaining loop located on the rear portion of the hat. The free end of the strap is mated to the fixed end according to the size of the head of the of the child that is to wear the present invention thus allowing children of differing sizes to wear the same sized hat or for the hat to be adjusted to a child during different stages of growth. Selectively removable decorative ornaments could be included to allow a user to easily exchange ornaments such as different colored flower ornaments, cartoon characters, sport logos etc.

Figure 2:
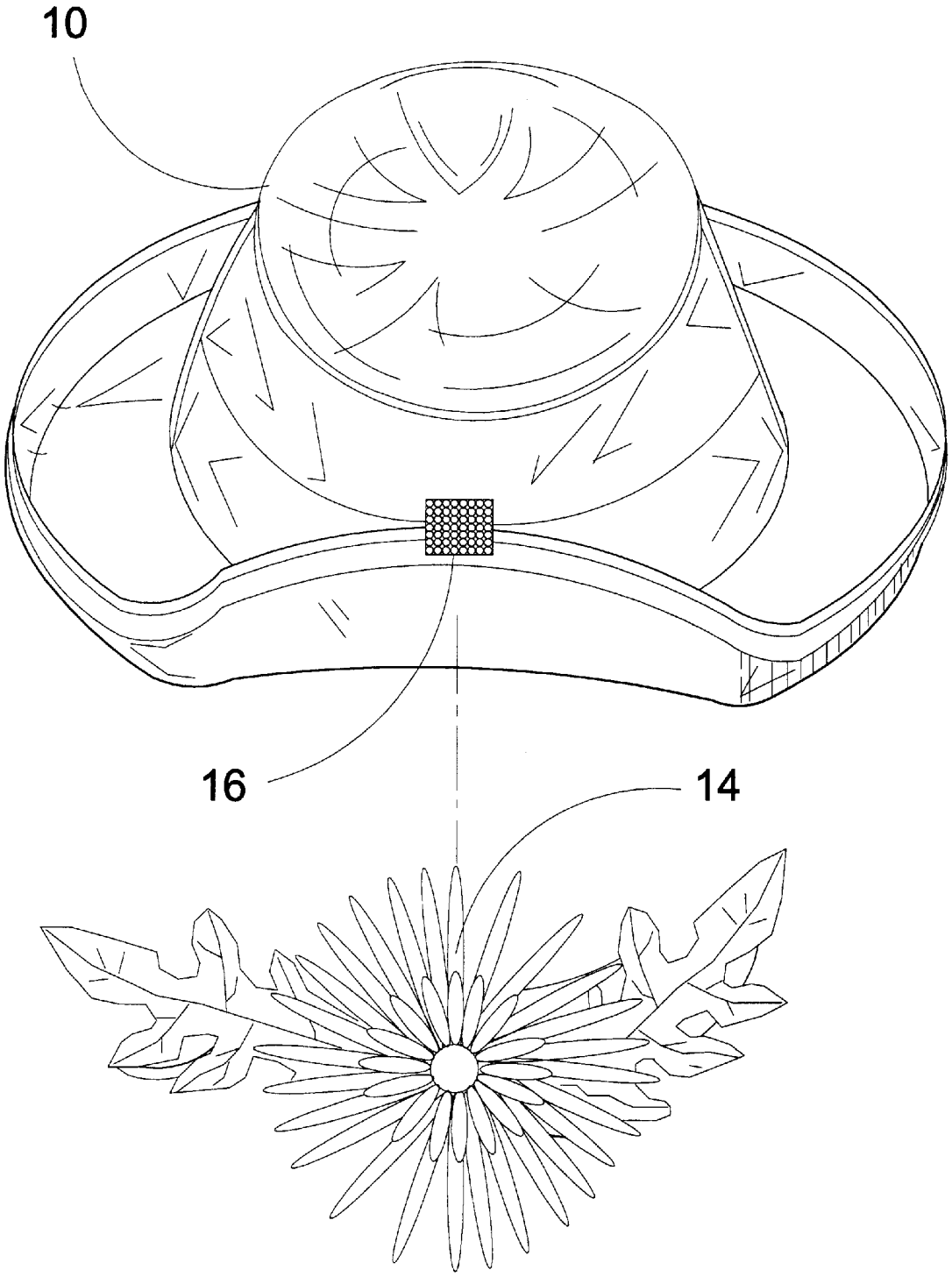
FIG. 2 is a perspective view of the present invention.

Turning to FIG. 2, shown therein is a perspective view of the present invention 10 showing the removably attachable flower ornament 14 removed from its attachment means 16, in this case a hook and loop fastener 16. A plurality of interchangeable ornaments could be provided.

Figure 3:
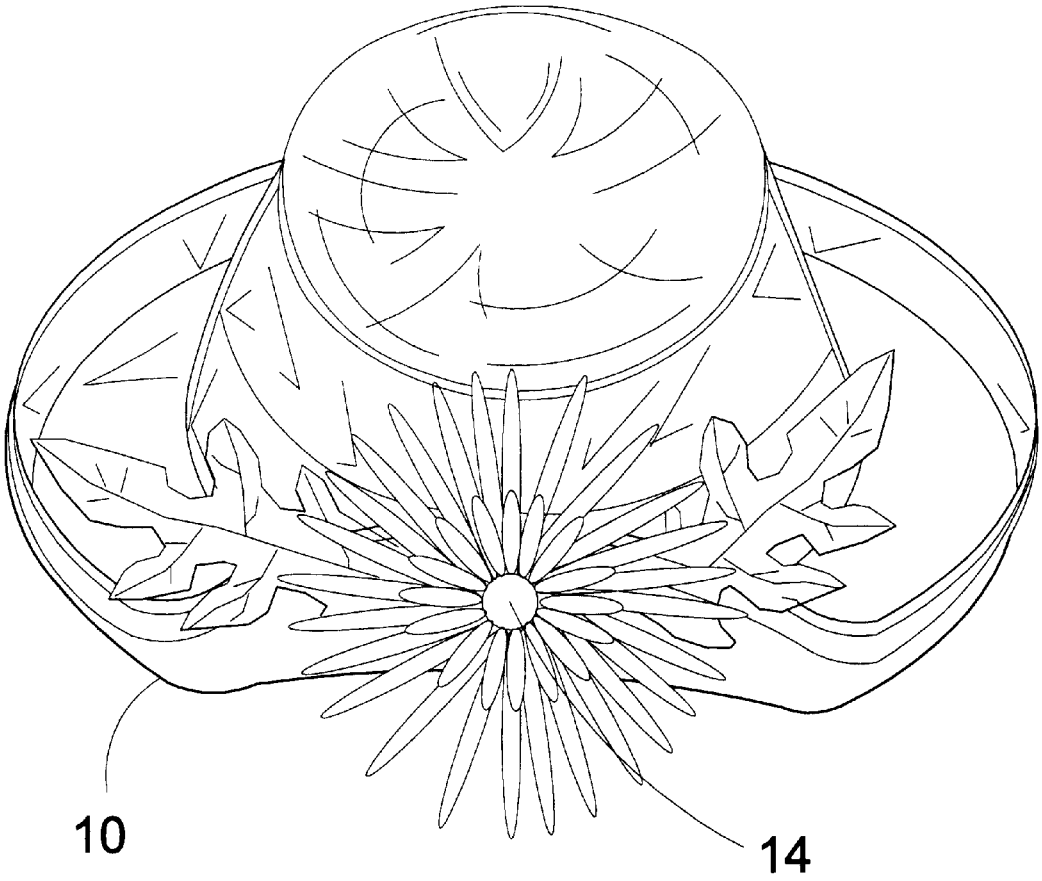
FIG. 3 is a perspective view of the present invention.

Turning to FIG. 3, shown therein is a perspective view of the present invention 10 showing the removably attachable flower ornament 14 attached to the hook and loop attachment means 16 (not visible).

Figure 4:
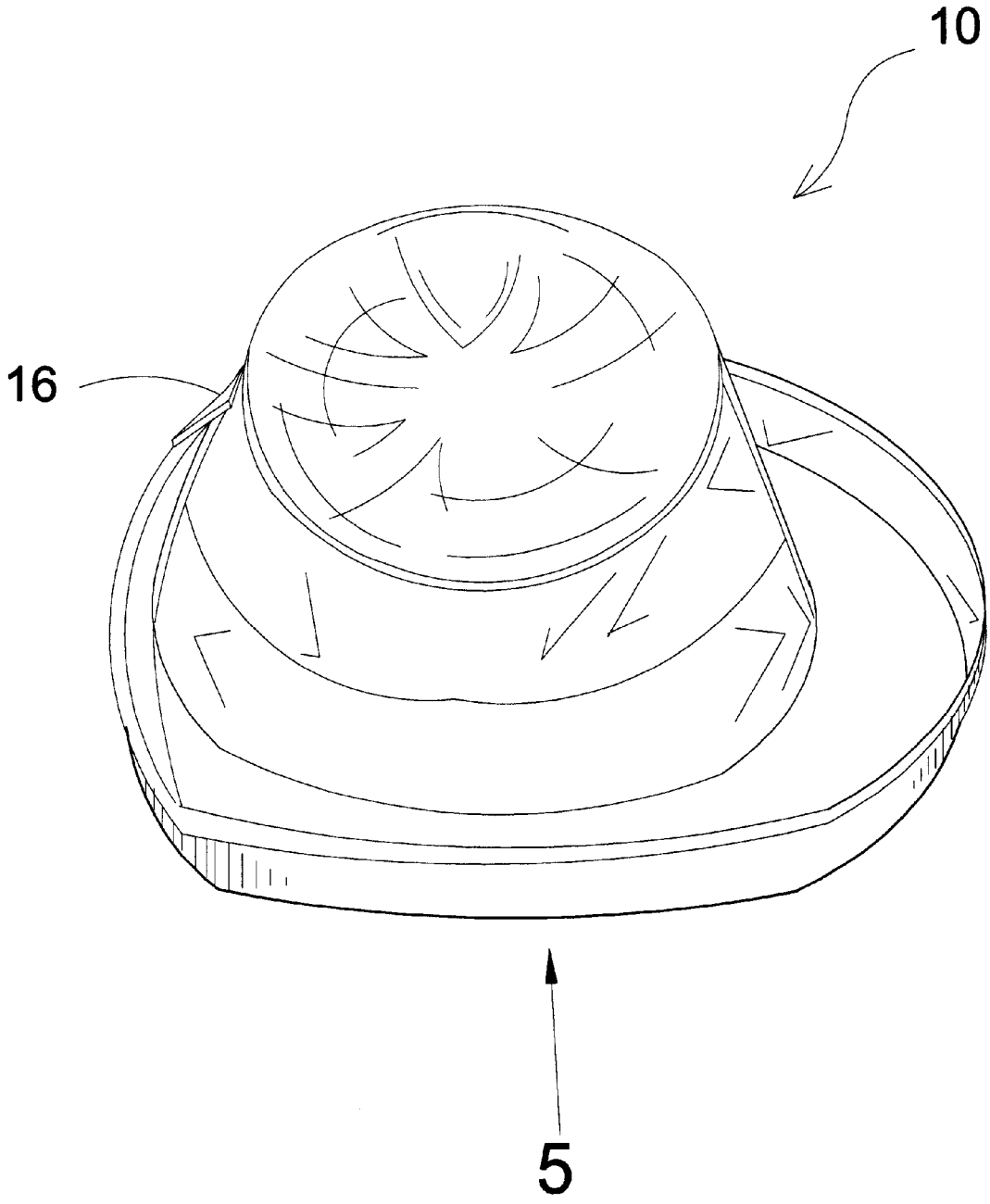
FIG. 4 is a side view of the present invention.

Turning to FIG. 4, shown therein is a side view of the present invention 10. The present invention provides an elastic band within the inner portion of the hat member 10. The band maintains a snug fit to the infant or toddlers head by means of being an adjustable hook and loop strap (not visible). Fastener means 16 on the front of the hat is also shown.

Figure 5:
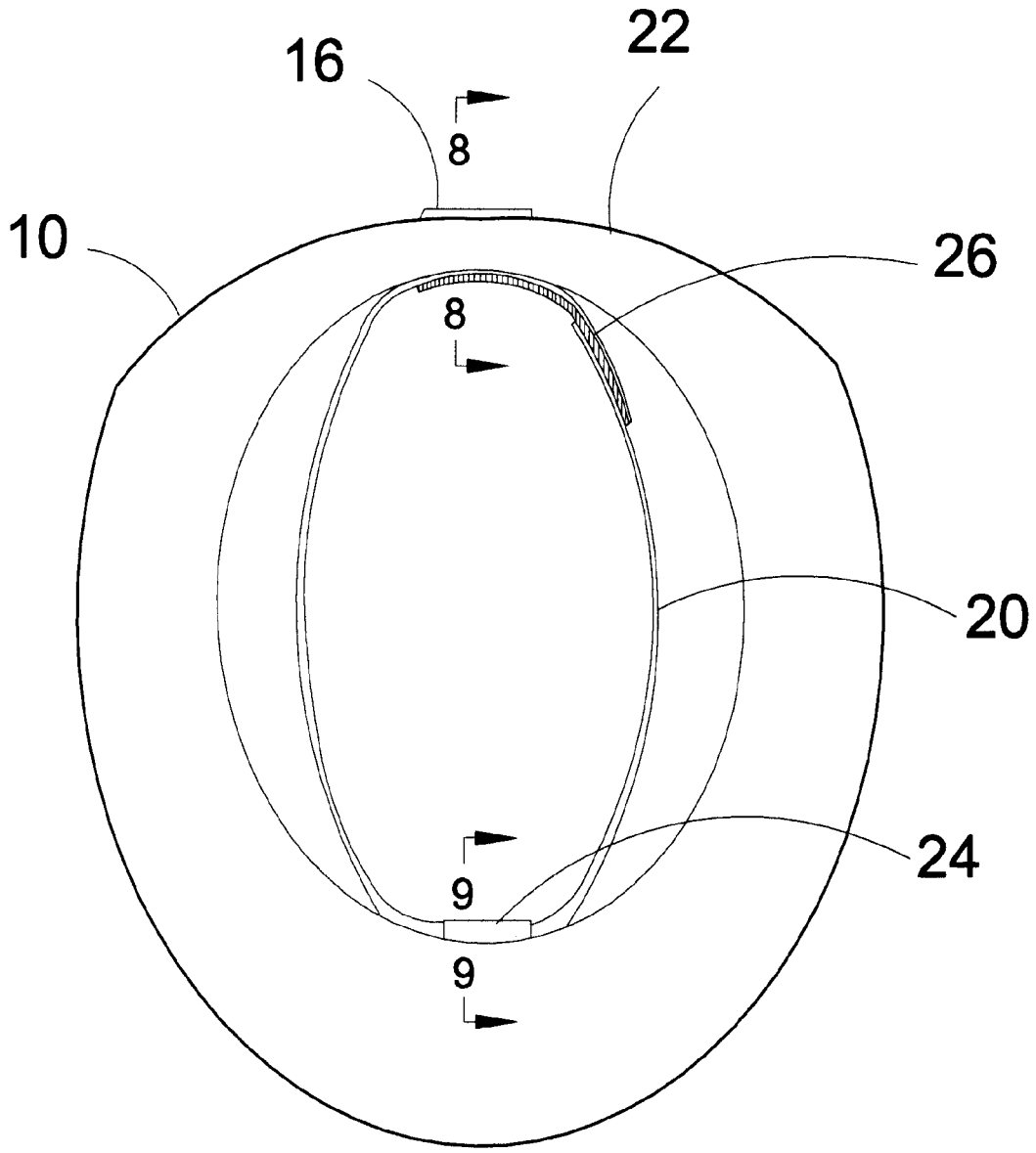
FIG. 5 is a bottom view of the present invention.

Turning to FIG. 5, shown therein is a bottom view of the present invention 10 showing the inside of the hat 10. One end of the elastic adjustable band 20 is permanently affixed to a front portion 22 of the hats interior and the second end is passed through the retaining loop 24 in the rear portion of the hat and looped back to the first end where the corresponding mating hook and loop end sections 26 connect to each other. Also shown is the hook and loop fastener 16. The free end of the strap 20 is mated to the fixed end according to the size of the head of the of the child that is to wear the present invention thus allowing children of differing sizes to wear the same sized hat or for the hat to be adjusted to a child during different stages of growth.

Figure 6:
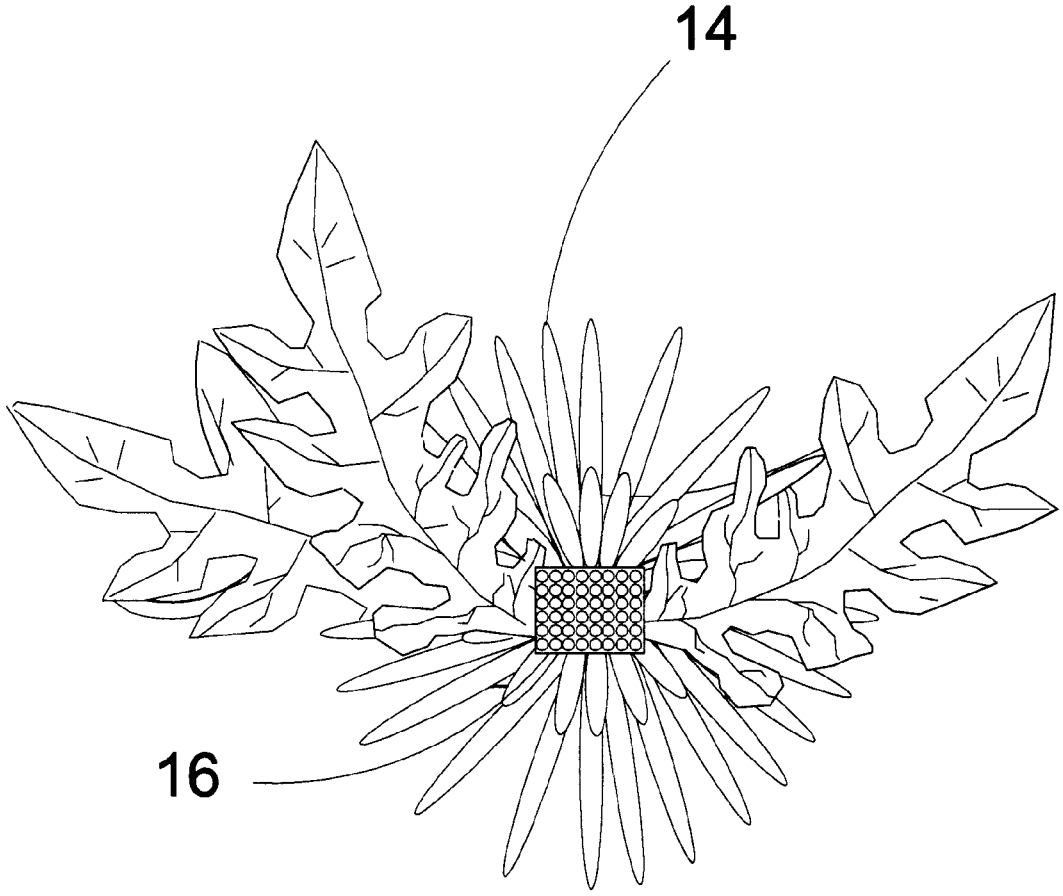
FIG. 6 is a rear view of the decorative flower attachment.

Turning to FIG. 6, shown therein is a rear view of the decorative flower attachment. The flower attachment decoration 14 attaches to a front portion of the hat by means of mating hook and loop means or elements 16. The decorative ornament 14 can take the form of any item having the mating hook and loop element 16 thereon.

Figure 7:
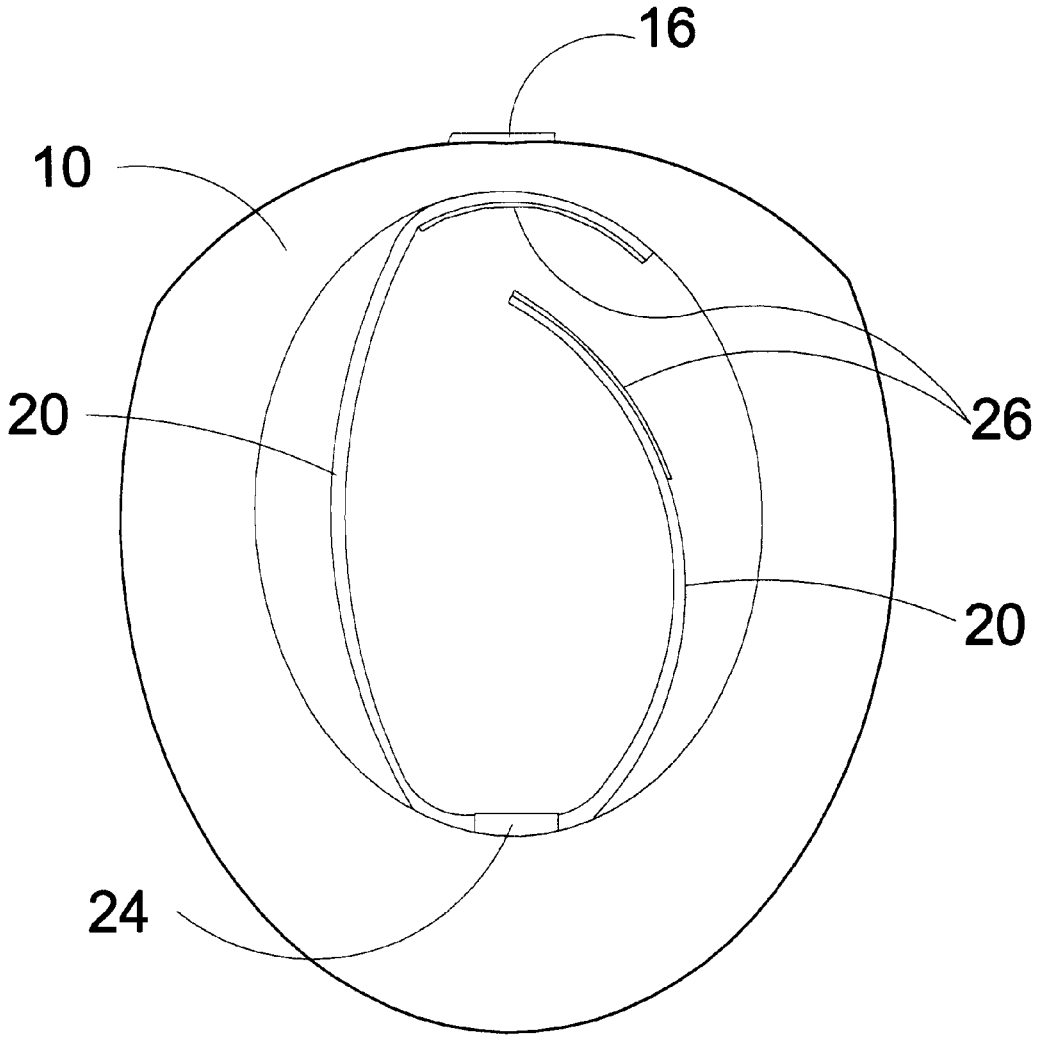
FIG. 7 is a bottom view of the present invention.

Turning to FIG. 7, shown therein is a bottom view of the present invention 10 with the elastic strap or band 20 open or unconnected and ready to mate the two hook and loop section ends 26. Also shown is the front hook and loop fastener 16 along with the rear retaining loop 24.

Figure 8:
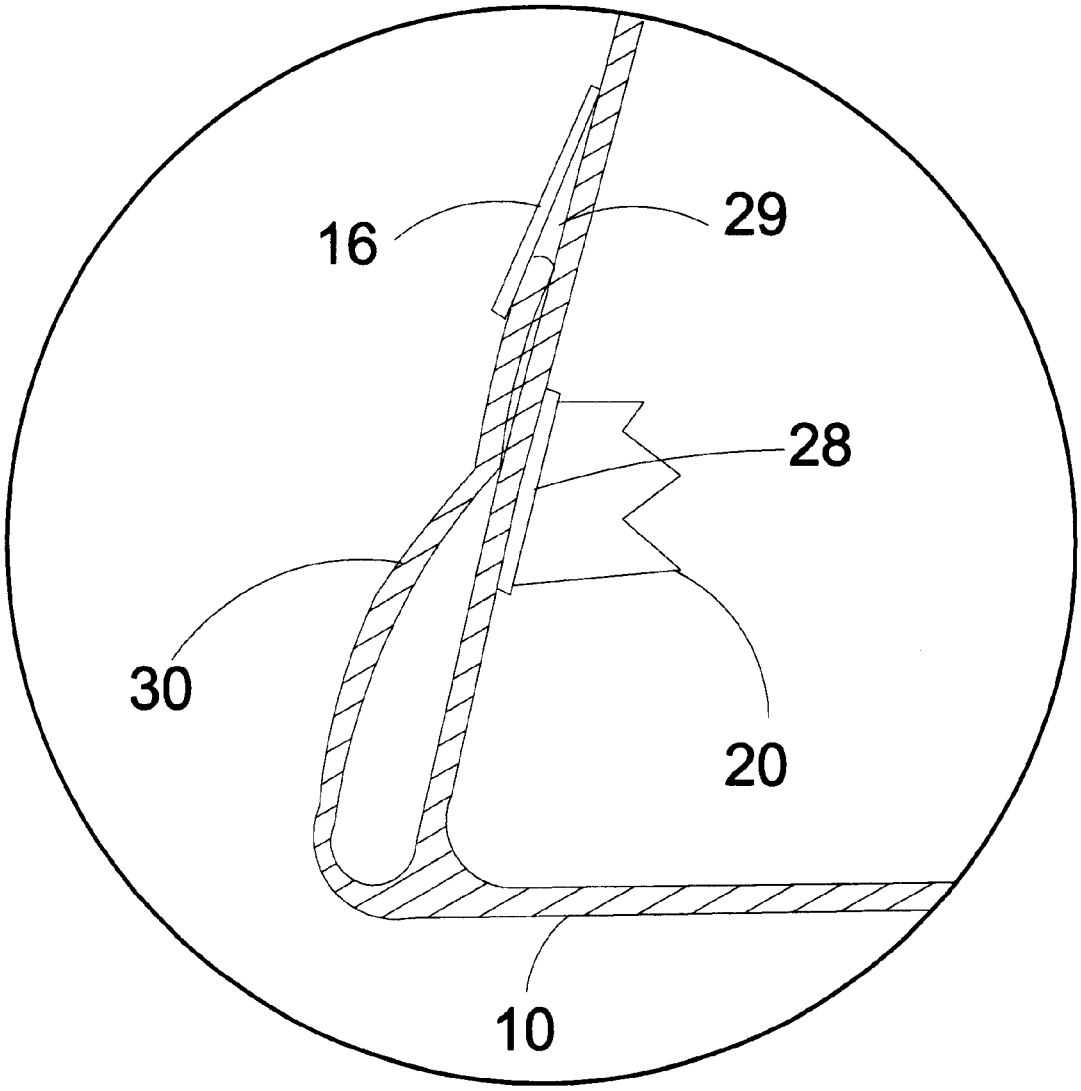
FIG. 8 is a cross-sectional side view of the fixed end of the elastic band.

Turning to FIG. 8, shown therein is a cross-sectional side view of the front fixed end of the elastic band 20. An elastic band 20 is located on the inner portion of the hat 10 and is adhesively attached on one end at 28 to the hat. Another hook and loop strip or fastener 16 is adhesively attached at 29 to the outer portion of the hat 10 for attaching the decorative ornaments. Also shown is the front hat fold 30 in the brim of the hat 10.

Figure 9:
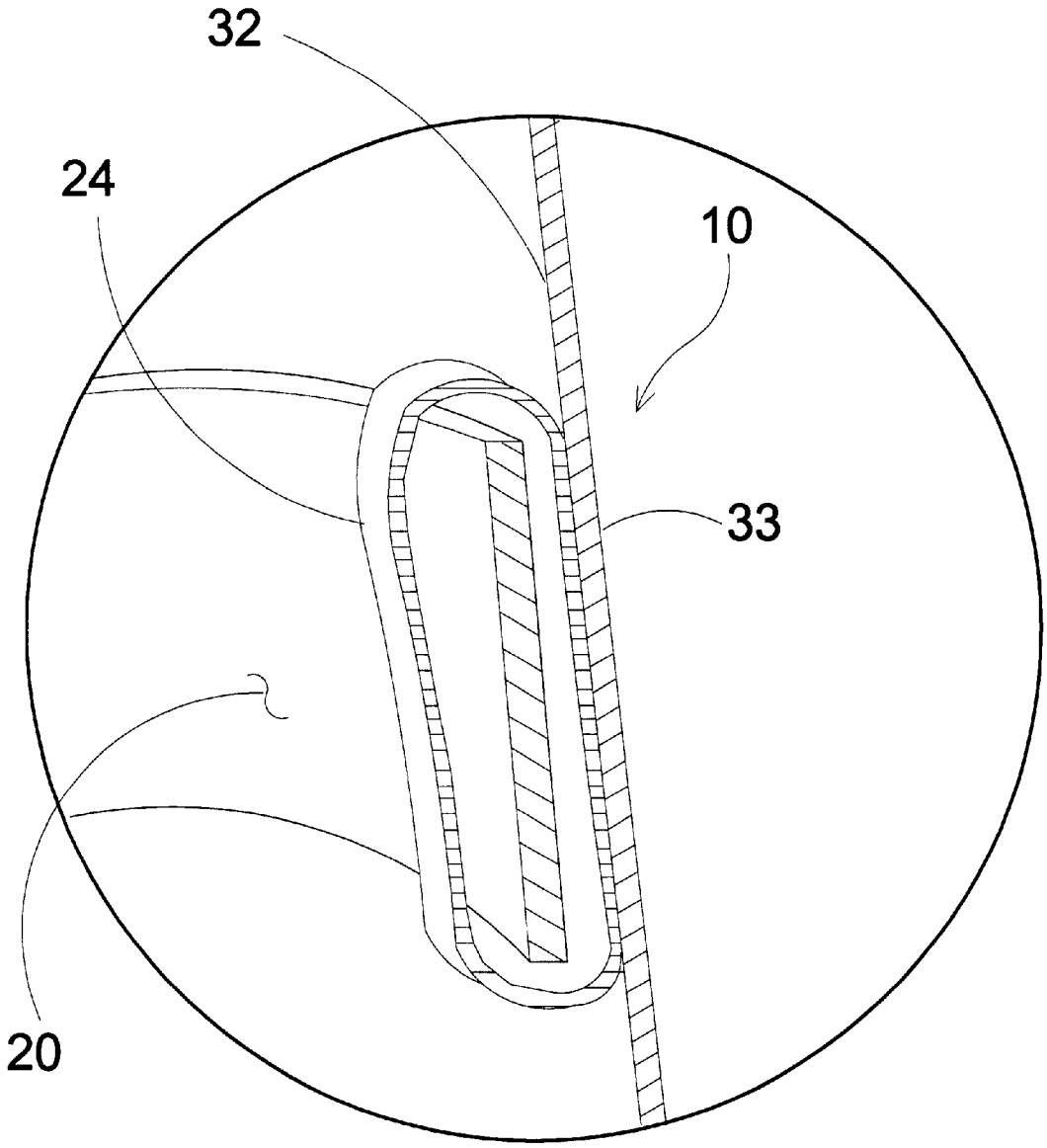
FIG. 9 is a cross-sectional side view of the retaining loop of the present invention.

Turning to FIG. 9, shown therein is a cross-sectional view of the rear retaining loop 24. One end of an adjustable band 20 passes through a retaining loop 24 located at the inner wall 32 of the rear portion of the hat 10. The hat will stay centered and secured to the head when the band 20 is adjusted to fit the users head. The elastic band 20 is selectively adjustable by means of mating elements of hook and loop fasteners 26. Also shown is the outside wall 33 of the hat 10.

Figure 10:
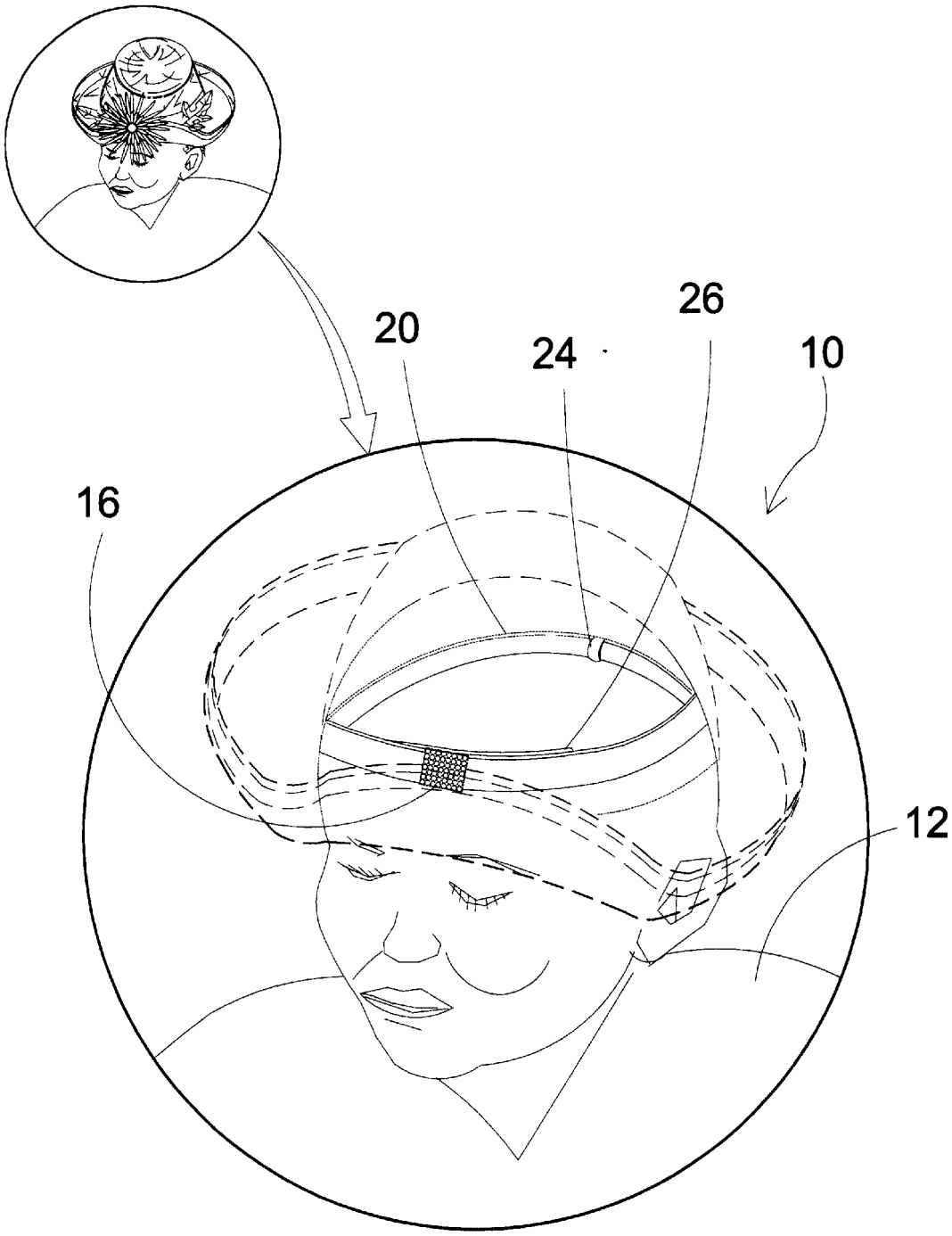
FIG. 10 is a front view of the present invention in use.

Turning to FIG. 10, shown therein is a front view of the present invention 10 in use. The elastic strap 20 is located within the inner portion of the hat 10 and is adjustable to fit upon an infant or a toddler's head 12. Shown is the rear retaining loop 24, the mating hook and loop ends 26 and the front hook and loop fastener 16.

Figure 11:
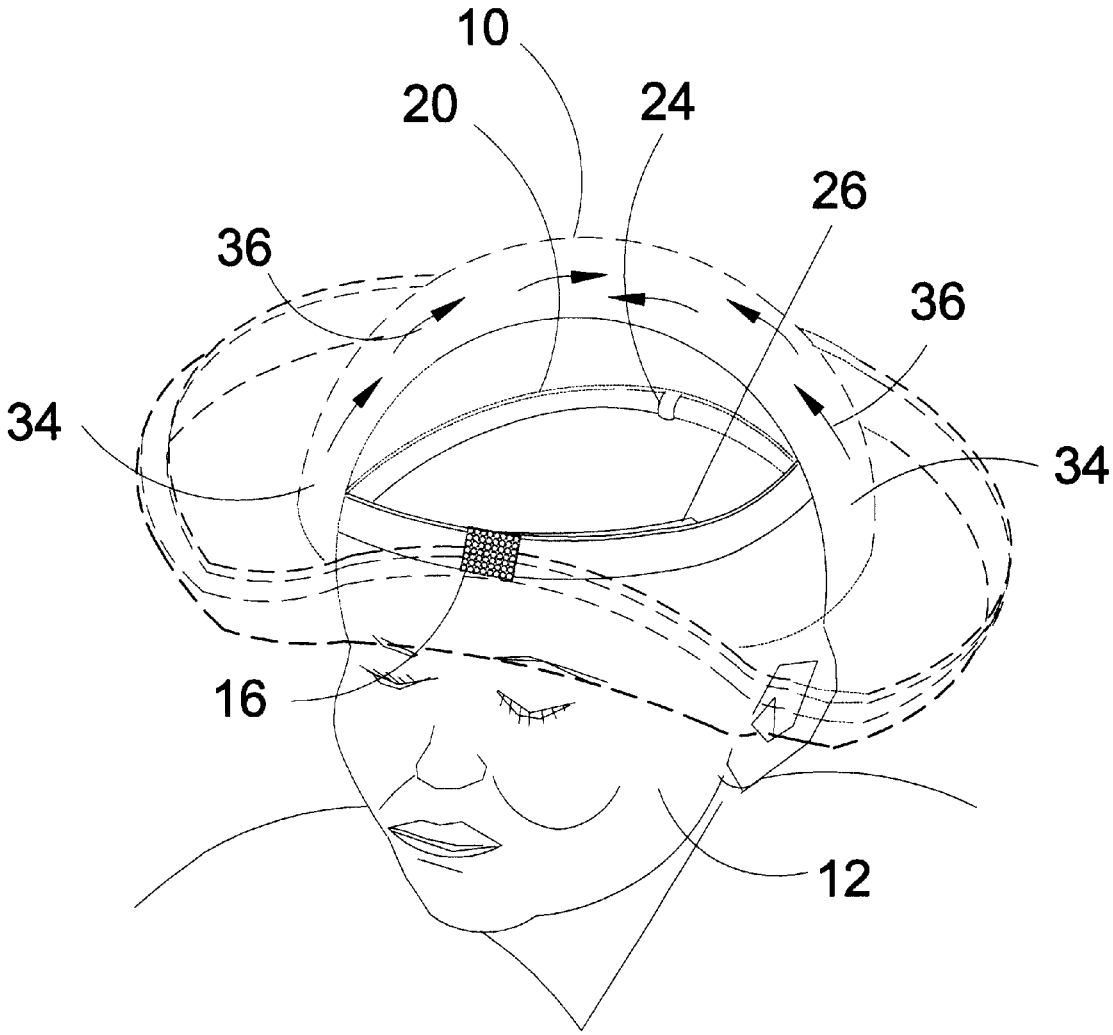
FIG. 11 is a front view of the present invention in use.

Turning to FIG. 11, shown therein is a front view of the present invention 10 in use in a case where it is oversized relative to the head of a user 12. The elastic band 20 pulls the front and rear portions of the hat against the users head 12 and creates a gap 34 between the hat 10 and the elastic band 20 on the right and the left sides of the users head 12. These openings 34 provide ventilation 36 for the head 12 thereby preventing overheating due to trapped hot air. Also shown is the rear retaining loop 24, the mating hook and loop ends 26 and the front hook and loop fastener 16.

What is claimed to be new and desired to be protected by letters patent is set forth in the appended claims:

I claim:

1. An adjustable hat for use by a child user, the hat having a brim thereon encircling the hat, comprising:

a) an elastic strap inside the hat, said strap disposed generally horizontally, said strap having a first end and a second end;

b) a first fastening means comprising hook and loop material disposed on said first end and said second end of said strap for connecting said strap ends together;

c) a second fastening means comprising adhesive for fixedly connecting said first end of said strap to an inner front of said hat;

d) a loop disposed in an inner rear of the hat, said strap slidably passing through said loop, said strap length thereby being made adjustable, said strap and an inner portion of the hat have a gap formed therein, said gap being formed on each side of the head of the user;

e) the brim of said hat folded up at a front of said hat and a third fastening means disposed on an outer front of the hat overlapping said brim and adhesively attached to an outer portion of said hat for receiving an ornament; and, f) said ornament removably attached to said third fastening means on the front of the hat, said ornament being attached by hook and loop material, opposing portions of the interior of said hat to which the elastic band is secured to said hat helping keep the decorative ornament centered towards the front of said hat.

* * * * *